US007064638B1

(12) United States Patent
Muramatsu

(10) Patent No.: US 7,064,638 B1
(45) Date of Patent: Jun. 20, 2006

(54) ELECTRICAL SWITCH

(75) Inventor: Naoki Muramatsu, Tokyo (JP)

(73) Assignee: Mitsubishi Denki Kabushiki Kaisha, Tokyo (JP)

( * ) Notice: Subject to any disclaimer, the term of this patent is extended or adjusted under 35 U.S.C. 154(b) by 526 days.

(21) Appl. No.: 10/220,819

(22) PCT Filed: Jul. 13, 2000

(86) PCT No.: PCT/JP00/04678

§ 371 (c)(1),
(2), (4) Date: Sep. 6, 2002

(87) PCT Pub. No.: WO02/07179

PCT Pub. Date: Jan. 24, 2002

(51) Int. Cl.
*H01H 67/02* (2006.01)

(52) U.S. Cl. ..... 335/132

(58) Field of Classification Search ..... 335/131–133, 335/192–194

See application file for complete search history.

(56) References Cited

U.S. PATENT DOCUMENTS

| | | | | |
|---|---|---|---|---|
| 3,057,047 | A | 10/1962 | Zimmer | |
| 3,168,627 | A | 2/1965 | Gilley | |
| 3,219,781 | A | 11/1965 | Miller et al. | |
| 3,602,850 | A * | 8/1971 | Grunert | 335/133 |
| 3,727,157 | A * | 4/1973 | Grunert et al. | 335/132 |
| 4,739,293 | A * | 4/1988 | Hurley et al. | 335/132 |
| 5,128,825 | A * | 7/1992 | Hurley et al. | 361/154 |
| 5,374,912 | A * | 12/1994 | Houck, III | 335/132 |
| 5,680,083 | A * | 10/1997 | Kogawa et al. | 335/132 |

FOREIGN PATENT DOCUMENTS

| | | |
|---|---|---|
| EP | 1571589 | 7/1980 |
| JP | 59-177980 | 10/1984 |
| JP | 61-133527 | 6/1986 |
| JP | 62-71138 A | 4/1987 |
| JP | 1-102828 A | 4/1989 |
| JP | 1-286223 A | 11/1989 |

OTHER PUBLICATIONS

Microfilm of the specification and drawings annexed to the request of Japanese Utility Model Application No. 34878/1974 (Laid-open No. 125053/1975) (Hitachi Ltd.), Oct. 14, 1975 (Family: none).
International Search Report.

* cited by examiner

*Primary Examiner*—Lincoln Donovan
*Assistant Examiner*—Bernard Rojas
(74) *Attorney, Agent, or Firm*—Sughrue Mion, PLLC

(57) ABSTRACT

An electrical switch having an actuator 130, a contact station 112, and a base 110. The actuator 130 includes a movable portion 130*f* which moves translationally from a first position to a second position when a voltage is applied thereto and which returns back from the second position to the first position when the voltage is removed. The contact station 112 is provided in a center portion of the base 110 so as to fix contact portions 101*s* having stationary contacts 101*a* of stationary contactors 101. Movable contactors 103 each are made of a beam material and each have one end portion coupled with and fixed to a housing, and have another end portion provided with a movable contact 103*a*. An operational arm 105 has one end coupled with the movable portion 130*f* of the actuator 130, and the other end connected to the other end portions of the movable contactors 103.

7 Claims, 8 Drawing Sheets

ELECTRICAL SWITCH

TECHNICAL FIELD

The present invention relates to an electrical switch which has a displacement enlarging member for enlarging the quantity of displacement of a drive source and which performs opening/closing on the basis of contacts through the displacement enlarging member.

BACKGROUND ART

A conventional electrical switch will be described with reference to FIG. 10 disclosed in Japanese Patent Laid-Open No. 177980/1984. In FIG. 10, the electrical switch 1 is configured as follows. That is, a buckling beam 4 is attached to an end of a piezoelectric element 3 attached into a housing 2 so that the axis of the buckling beam 4 coincides with the direction of expansion/contraction of the piezoelectric element 3. An opposite end of the buckling beam 4 is supported by a concave portion 2*u* of the housing 2. A screw 7 is provided in the housing 2 so that the initial displacement of the buckling beam 4 can be adjusted and so that the screw 7 can function as a backstop.

The buckling beam 4 is provided with an arm 9 extended from a support portion of the buckling beam 4 at one end. A movable contact 9*a* is provided at a forward end of the arm 9. Stationary contacts 10*a* and 10*b* of a stationary contactor 10 are provided opposite to the movable contact 9*a*.

The operation of the electrical switch configured as described above will be described with reference to FIG. 10. When a voltage is now applied to the piezoelectric element 3, axial displacement occurs in the buckling beam 4 as represented by the arrow A. The buckling beam 4 is deformed in a direction perpendicular to the displacement given to an end of the buckling beam 4, so that maximum displacement occurs in the center portion of the buckling beam 4. The opposite end of the buckling beam 4 rotates. In parallel with this rotation, the arm 9 also rotates, so that the displacement is enlarged at the forward end to thereby make the movable contact 9*a* touch the stationary contact 10*a*.

Another conventional electrical switch will be described with reference to FIG. 11 disclosed in Japanese Patent Laid-Open No. 133527/1986. In FIG. 11, the electrical switch is configured as follows. That is, a piezoelectric element 13 having terminals 13*a* is provided in a housing 11 so that the piezoelectric element 13 is erected. A lever 15 is supported to a rack portion 14 of the housing 11 so that the lever 15 can rotate around a protrusive portion 15*a* of the lever 15 as a fulcrum. A protrusive portion 15*b* of the lever 15 is engaged with a free end of the piezoelectric element 13. A forward end 15*c* of the lever 15 abuts on a base portion of a movable contact piece 17.

Switching means 20 has a movable spring 18 which is separated from the movable contact piece 17 by cutting. The switching means 20 is formed so that it can make snap action operation. The movable contact piece 17 is locked onto a support piece 16 fixed to a base portion 12 of the housing 11 at its lower end. The movable contact piece 17 has a movable contact 17*a* at its upper end. Stationary contactors 22 and 23 are provided in an upper portion of the housing 11 so that the stationary contactors 22 and 23 are erected. Stationary contacts 22*a* and 23*a* are provided in lower portions of the stationary contactors 22 and 23 respectively.

The operation of the electrical switch configured as described above will be described with reference to FIG. 11. In a state in which no voltage is applied between the terminals 13*a*, the movable contact piece 17 is urged to rotate counterclockwise by the spring force of the movable spring 18 as shown in FIG. 11.

When a voltage is now applied between the terminals 13*a*, the voltage is applied to the piezoelectric element 13. As a result, the piezoelectric element 13 is expanded in the direction of the arrow Q to press the protrusive portion 15*b* of the lever 15, so that the lever 15 rotates counterclockwise around the protrusive portion 15*a* as a fulcrum. Hence, the forward end 15*c* of the lever 15 moves in the direction of the arrow R to thereby urge the movable contact piece 17 to move in the same direction. When the movable contact piece 17 moves by a predetermined distance, the movable contact piece 17 is inverted by the snap action operation so that the movable contact 17*a* touches the stationary contact 23*a*.

On the other hand, when the voltage between the terminals 13*a* is cut off, the piezoelectric element 13 is contracted. As a result, the movable contact piece 17 rotates counterclockwise so that the movable contact 17*a* touches the stationary contact 22*a*.

In the electrical switch 1 shown in FIG. 10, however, abrasion occurs in the concave portion 2*u* because the forward end portion of the buckling beam 4 is frictionally slid on the concave portion 2*u* of the housing 2 by the expansion of the piezoelectric element 3 in the direction of the arrow A. Hence, because the quantity of displacement of the forward end of the arm 9 varies largely in accordance with the abrasion, it is difficult to keep the contact pressure between the stationary contact 10*a* or 10*b* and the movable contact 9*a* at a proper value. There has been a problem that chattering occurs easily in contact between the stationary contact 10*a* or 10*b* and the movable contact 9*a*.

There has been also a problem that the spring 7 is required for contracting the buckling beam 4 to bend the buckling beam 4 to thereby always rotate the arm 9 counterclockwise.

On the other hand, the electrical switch shown in FIG. 11 is complex in mechanism because the electrical switch has a displacement enlarging mechanism constituted by a lever 15 having protrusive fulcra 15*a* and 15*b*, and a snap action mechanism constituted by switching means 20. Moreover, because the operation of the snap action mechanism is impulsive, chattering occurs in contact between the stationary contact 22*a* or 23*a* and the movable contact 17*a*. There has been a problem that abrasion occurs easily due to the protrusive fulcra 15*a* and 15*b* as well as electrical abrasion in the contacts is intensive.

DISCLOSURE OF THE INVENTION

The present invention is designed to solve the aforementioned problems and to provide an electrical switch having a displacement enlarging member in which an enlarged quantity of displacement is obtained when a slight translational-drive displacement is made to act on a movable portion.

According to the invention, an electric switch has a feature to have: a housing; a stationary contactor including a stationary contact; drive means received in the housing and including a movable portion which moves translationally from a first position to a second position when a voltage is applied thereto and which returns back from the second position to the first position when the voltage is removed; a mount portion provided in the housing so as to be protrusive and for fixing contact portions having the stationary contacts of the stationary contactors; a movable contactor made of a beam material and having one end portion coupled with and fixed to the housing, and the other end portion provided with a movable contact electrically connected/disconnected to/from the corresponding stationary contact; and an operating member having one end coupled with a movable portion of the drive means, and the other end connected to the other end portion of the movable contactor.

According to the electrical switch, the operating member and the movable contactor constitute a displacement enlarging member. When the movable portion of the drive means is translationally displaced from the first position to the second position, the quantity of movement of the movable contact of the movable contactor is enlarged so that the movable contact are electrically connected/disconnected to/from the stationary contact.

Next, according to the invention, the electrical switch has a feature in that the movable contactor and the operating member are substantially formed into a V shape.

Next, according to the invention, the electrical switch has features in that: the movable contactors are provided; the operating members are provided; the movable contactors are electrically insulated from one another; the mount portion is provided in a center portion of the housing so as to be protrusive and includes a substantially cylindrical pillar; and the stationary contactors are fixed to the pillar.

Next, according to the invention, the electrical switch has a feature in that engagement grooves are provided in the pillar of the mount portion so that the stationary contactors are engaged with and fixed into the engagement grooves respectively.

Next, according to the invention, the electrical switch has features in that: a concave portion having an opening is provided in the pillar of the mount portion; and the contact portions having the stationary contacts of the stationary contactors are inserted in the opening of the concave portion.

Next, according to the invention, the electrical switch has features in that a substantially T-shaped hole is formed in a neighbor of each of the movable contacts of the movable contactors; and substantially T-shaped hooks are formed in the other end portion of the operating member.

Next, according to the invention, the electrical switch has features in that: a hole having a protrusive piece is formed in a neighbor of each of the movable contacts of the movable contactors; holes are formed in the operating member so that the protrusive pieces are engaged with the holes respectively; and eyelet rivets each made of a metal are caulked in the holes respectively.

Next, according to the invention, the electrical switch has features in that: a first hole is formed in a neighbor of each of the movable contacts of the movable contactors; the operating member is made of an electrical conductor and second holes are formed at a forward end portion of the operating member so as to be curved; and coupling members each of which is made of an electrically insulating material and shaped like a dumbbell are provided for coupling the first holes of the movable contactors with the second holes.

BEST MODE FOR CARRYING OUT THE INVENTION

Embodiment 1

Figure 1:
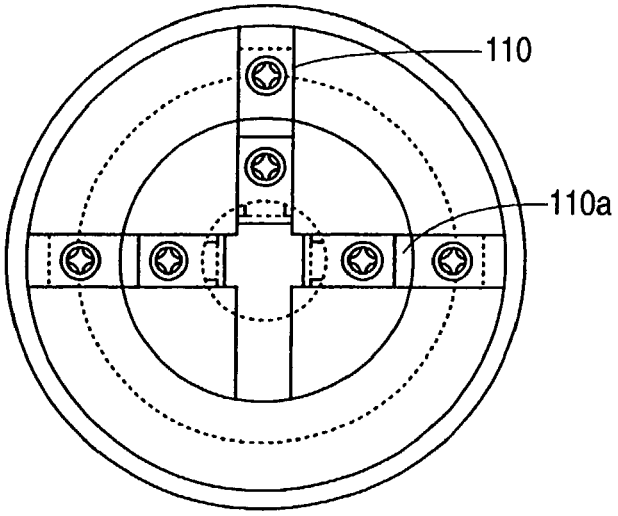
FIG. 1 is a plan view (a) and a front sectional view (b) of an electrical switch according to an embodiment of the invention.
Figure 1:
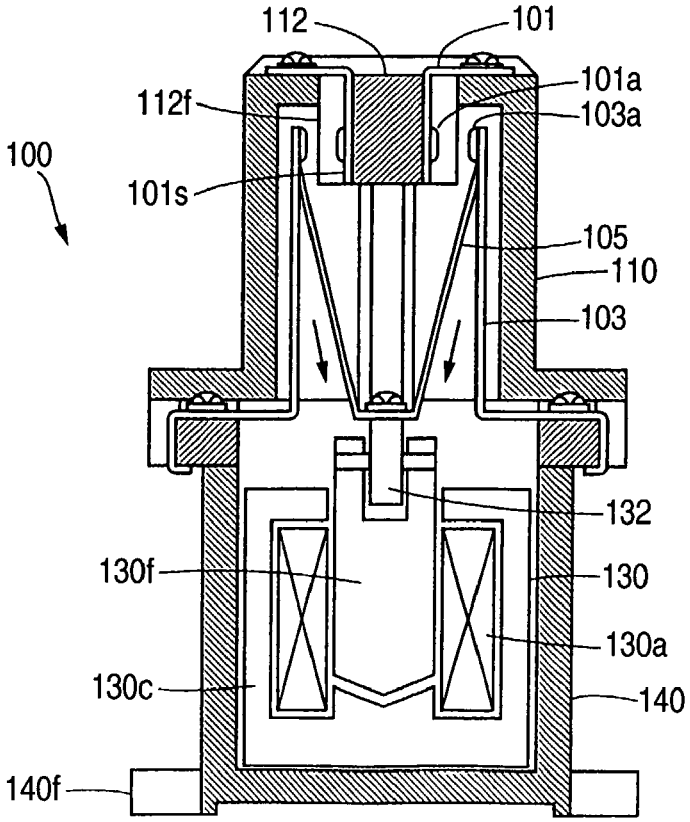
Figure 2:
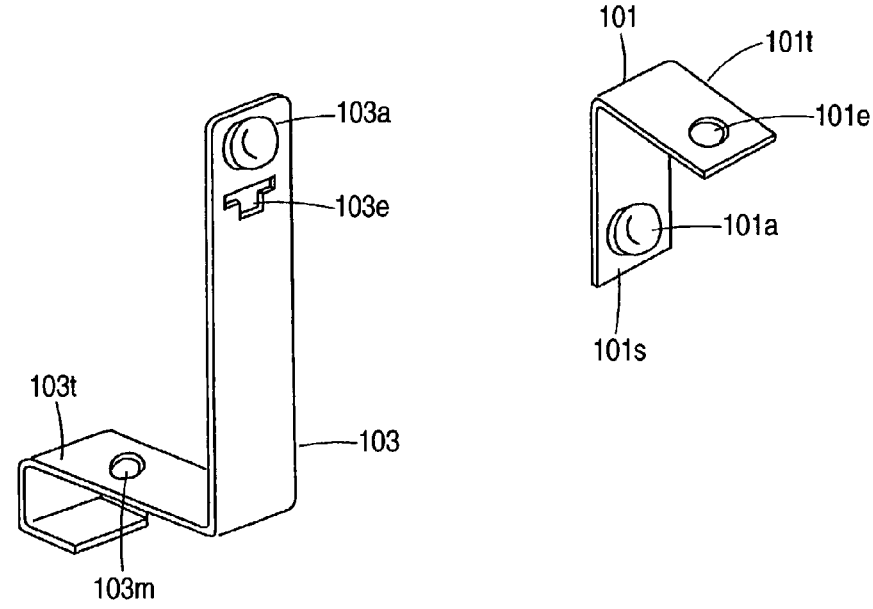
FIG. 2 is a perspective view of a movable contactor and a stationary contactor in FIG. 1.
Figure 3:
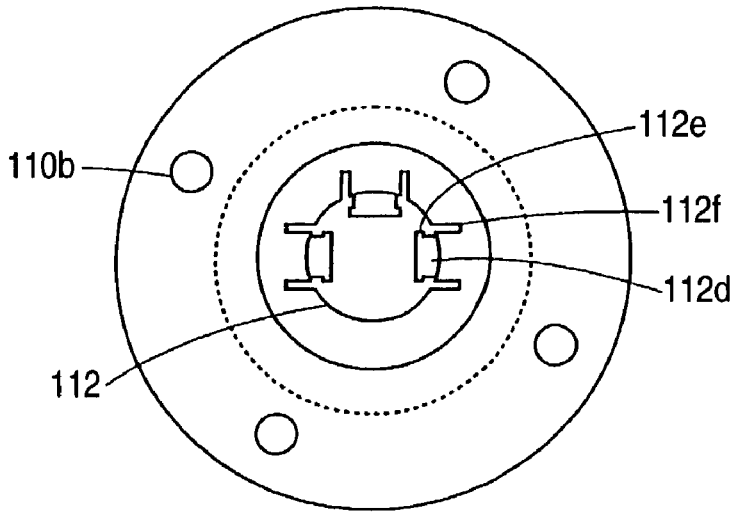
FIG. 3 is a plan view (a) and a front sectional view (b) of a base in FIG. 1.
Figure 3:
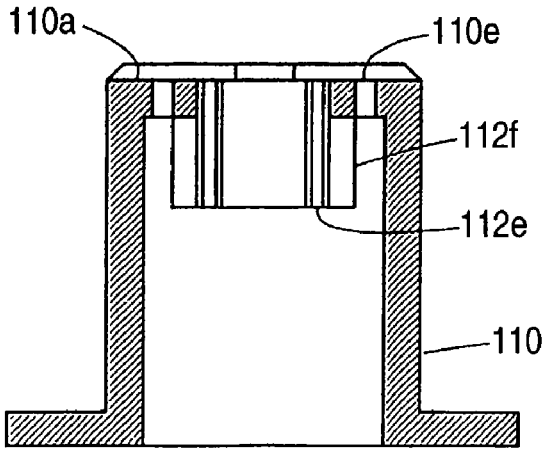
Figure 4:
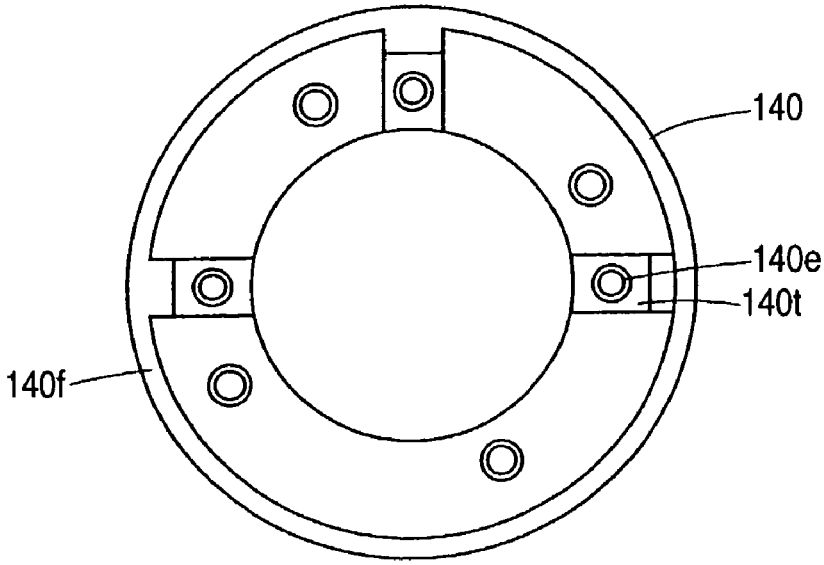
FIG. 4 is a plan view (a) and a front sectional view (b) of a mount rack in FIG. 1.
Figure 4:
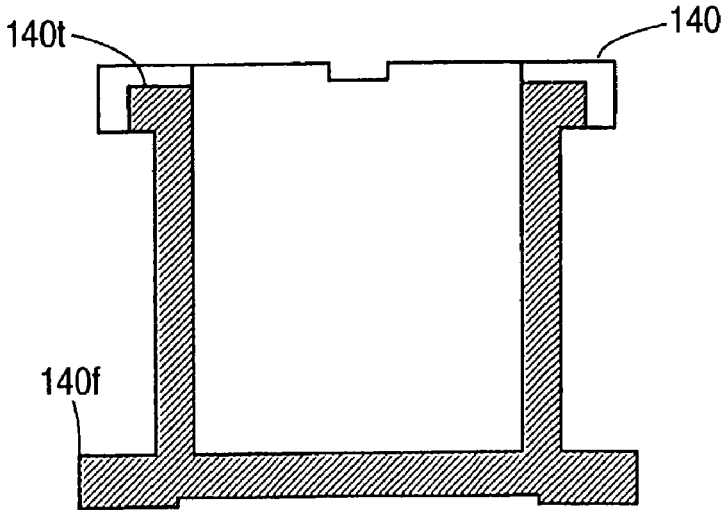
Figure 5:
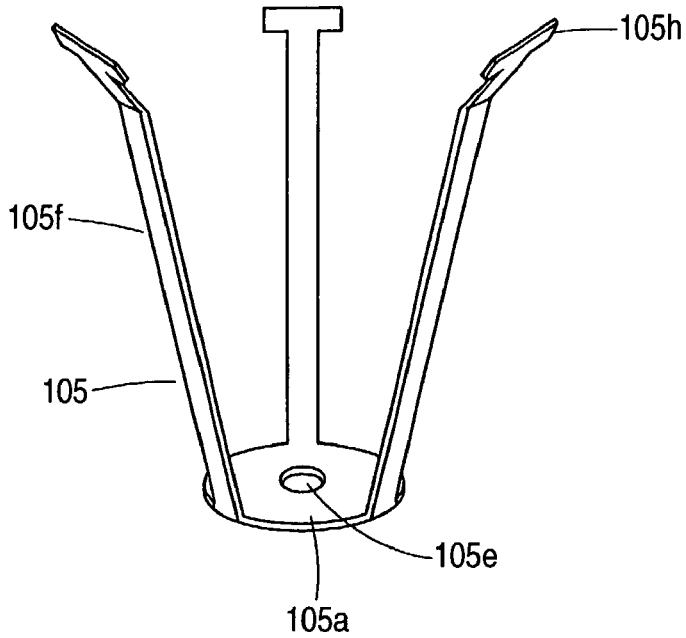
FIG. 5 is a perspective view of an operational arm in FIG. 1.

An embodiment of the invention will be described with reference to FIGS. 1 through 5. FIG. 1 is a plan view (a) and a front sectional view (b) of an electrical switch according to an embodiment of the invention. FIG. 2 is an exploded perspective view of a movable contactor and a stationary contactor in FIG. 1. FIG. 3 is a plan view (a) and a front sectional view (b) of a contact station. FIG. 4 is a plan view (a) and a front sectional view (b) showing a mount rack in FIG. 1. FIG. 5 is a perspective view showing an operational arm in FIG. 1.

In FIG. 1, the electrical switch 100 has: a base 110 to which stationary contactors 101 are attached and which includes movable contactors 103, and an operational arm 105 built-in; and a mount rack 140 to which the movable contactors 103 are attached and which includes an actuator 130 built in as drive means. Here, the base 110 and the mount rack 140 constitute a housing.

As shown in FIG. 2, each of the stationary contactors 101 is made of an L-shaped electrical conductor. A stationary contact 101*a* is fusion-bonded to a contact portion 101 is at an end of each of the stationary contactors 101. A threaded hole 101*e* is formed in a terminal portion 101*t* at the other end of each of the stationary contactors 101.

The base 110 is molded of a phenolic resin and cylindrically shaped like a brimmed hat. As shown in FIGS. 1 and 3, a concave portion 110*a* which is cut into a cross shape for fixing terminals 101*t* of the stationary contactors 101 is formed in an upper portion of the base 110. Threaded holes 110*e* are formed in fixed positions corresponding to the holes 101*e* in the terminals 101*t*. A contact station 112 is provided in an inner ceiling portion of the base 110 so that the contact portions 101*s* of the stationary contactors 101 are erected and received in the contact station 112.

Incidentally, a plurality of holes 110*b* for set-screws are formed in an outer brim portion of the base 110.

The contact station 112 is substantially cylindrical and is provided in the inside of the base 110 so as to be protruded. Three substantially U-shaped concave portions 112*d* are provided axially as a whole in the outer circumference of the contact station 112 so that the contact portions 101*s* of the stationary contactors 101 are inserted in the concave portions 112*d*. Engagement grooves 112*e* each having a depth substantially equal to the width and thickness of each of the stationary contactors 101 are formed in the deepest portion of corresponding one of the grooves 112*d* and on opposite sides so that opposite ends of each of the stationary contactors 101 are engaged with the engagement grooves 112*e*.

On this occasion, the concave portions 112*d* are provided for preventing arc from being spread. The arc is generated on the basis of electrical opening/closing between the stationary contact 101*a* of each stationary contactor 101 and the movable contact 103*a* of a corresponding movable contactor 103. Further preferably, plate-like fins 112*f* may be erected and fixed in the vicinity of the concave portions 112*d* so that the arc can be prevented more from being diffused.

As shown in FIG. 2, each of the movable contactors 103 is made of a substantially L-shaped beam-like electrical conductor. A contact 103*a* is fusion-bonded to one end portion of each of the movable contactors 103. A T-shaped hole 103*e* is formed below the contact 103*a*. A U-shaped terminal portion 103*t* is formed at the other end portion of each of the movable contactors 103 for fixing the movable contactors 103 to the mount rack 140. Holes 103*m* are formed in the terminal portions 103*t* respectively.

As shown in FIGS. 1 and 4, the mount rack 140 is made of a phenolic resin and shaped like a cylinder having an opened top surface. Flanges 140*f* are provided in opposite end portions of the mount rack 140. Three concave grooves 140*t* are formed in one of the flanges 140*f* for fitting and fixing the U-shaped terminal portions 103*t* of the movable contactors 103 into the grooves 140*t* respectively. Threaded holes 140*e* for fixing the movable contactors 103 are formed in the grooves 140*t* correspondingly to the holes 103*m* in the movable contactors 103.

As shown in FIG. 1, the actuator 130 is a plunger type solenoid fixed into the inside of the mount rack 140. The actuator 130 has a stationary portion 130*c*, and a movable portion 130*f*. The inside of the stationary portion 130*c* is formed as a hollow in which a coil 130*a* is provided. The movable portion 130*f* is inserted in the hollow portion of the stationary portion 130*c* and shaped like a cylinder. The movable portion 130*f* is formed so that the movable portion 130*f* translationally moves from a first position (in a state shown in FIG. 1) to a second position (in a state in which the movable portion 130*f* and the stationary portion 130*c* are adsorbed to each other) when a voltage is applied to the coil 130*a*, and so that the movable portion 130*f* returns back from the second position to the first position when the application of the voltage is removed.

A cylindrical pin 132 is erected and fixed in the center of the movable portion 130*f*. A threaded hole is formed in the center of a forward end surface of the pin 132.

As shown in FIGS. 1 and 5, the operational arm 105 is made of an engineering resin or processed ceramics as an electric insulator. The operational arm 105 has a ring-like center portion 105*a*, and three finger pieces 105*f* which are extended radially from the ring-like center portion 105*a* so as to be shaped like a cone as a whole. A hole 105*e* for screwing is formed in the center portion 105*a* so that the center portion 105*a* is fixed, by a screw, to the threaded hole of the pin 132 interlocked with the actuator 130.

A substantially T-shaped hook 105*h* bent outward at a predetermined angle is provided at a forward end portion of each of the finger pieces 105*f*.

Figure 6:
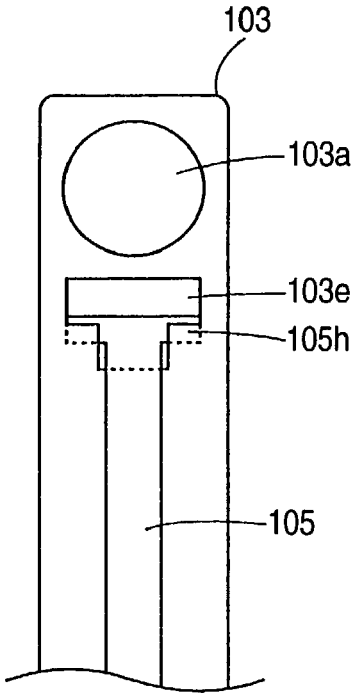
FIG. 6 is a side view (a) and a front sectional view (b) showing a state in which the operational arm and the movable contactor in FIG. 1 are coupled with each other.
Figure 6:
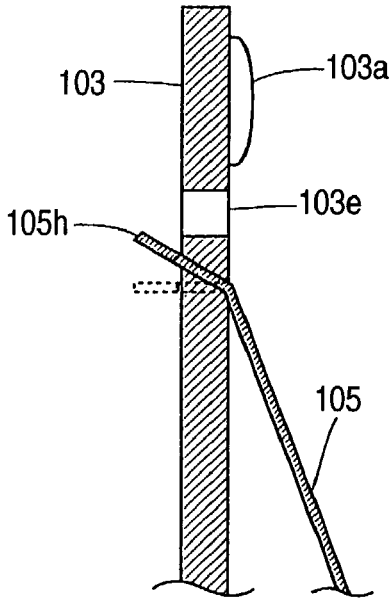

The reason why the hook 105*h* is bent at a predetermined angle is that the hook 105*h* can be easily caught and fixed into the hole 103*e* of a corresponding movable contactor 103 as shown in FIG. 6. Hence, the operation arm 105 and the movable contactors 103 substantially form a V shape and one end of the operational arm 105 is translationally displaced to thereby form a displacement enlarging member in which the quantity of displacement of the forward end portion of each of the movable contactors 105 is enlarged.

Figure 7:
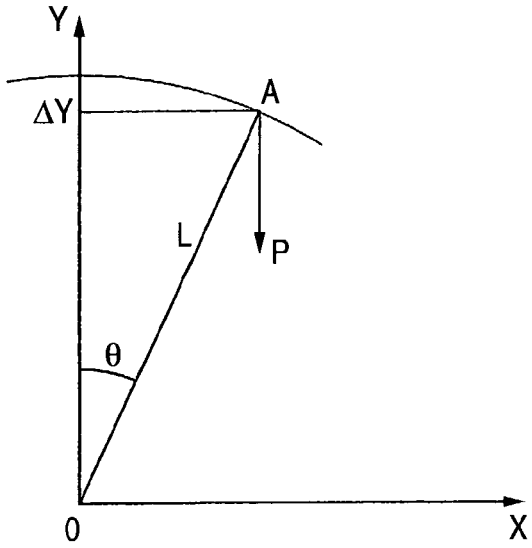
FIG. 7 is an explanatory view showing enlargement of the quantity of displacement of a forward end portion of the movable contactor in FIG. 2.

The reason why the quantity of translational displacement of the operational arm 105 is enlarged at the forward end portion of each of the movable contactors 103 will be described with reference to FIG. 7. FIG. 7 shows approximately a state in which a load acts on one end of the operational arm 105 as an elastic body so that a member is deformed so as to be bent. In FIG. 7, the symbol A designates a forward end of the operational arm 105, the symbol L designates the length of the operational arm 105, the symbol P designates the load, the symbols X and Y designate horizontal displacement and vertical displacement respectively, and the symbol θ designates a fine rotation angle.

From FIG. 7, the positional difference Δy, in the y-axis direction, of the portion A after rotation by θ is given as follows.

$$\Delta y = L(1-\cos\theta) \approx (L\theta^2)/2 \quad (1)$$

The horizontal displacement X of the portion A is given as follows.

$$X = L\sin\theta \approx L\theta \quad (2)$$

In the expression (1), Δy corresponds to the translational displacement of the operational arm 105. In the expression (2), X corresponds to the horizontally enlarged displacement of the movable contactor 103. From the expressions (1) and (2), the magnifying ratio G of the enlarged displacement X to the translational displacement θy is given as follows.

$$G = X/\Delta y \approx 2/\theta \quad (3)$$

For example, in the case where the rotation angle θ is 10°, then the magnifying ratio G is 11.55. That is, the horizontal displacement of the forward end portion of the movable contactor 103 becomes sufficiently larger than the translational displacement of the operational arm 105 in a range in which θ is small.

The operation of the electrical switch configured as described above will be described below mainly with reference to FIG. 1. Now, when a voltage is applied to the coil 130*a* of the actuator 130, the movable portion 130*f* translationally moves from the first position (in a state shown in FIG. 1) to the second position (in a state in which the movable portion 130*f* and the stationary portion 130*c* are adsorbed to each other) by electromagnetic suction force. With the translational movement of the movable portion 130*f*, the operational arm 105 is pulled in the direction of the arrow by the movable portion 130*f*, so that the movable contacts 103*a* of the movable contactors 103 move substantially horizontally (in FIG. 1) toward the stationary settings 101*a*. As a result, the movable contacts 103*a* abut and are pressed against the stationary contacts 101*a* respectively, so that the movable contactors 103 are electrically connected to the stationary contactors 101 respectively.

On the other hand, when the voltage applied to the coil 130*a* is cut off in the condition that the movable portion 130*f* of the actuator 130 is in the second position (in a state in which the movable portion 130*f* and the stationary portion 130*c* are absorbed to each other), the electromagnetic suction force of the movable portion 130*f* is eliminated. The movable portion 130*f* is pulled in a direction reverse to the arrow by the spring restoring force of the movable contactors 103 themselves through the operational arm 105. Hence, the movable contacts 103*a* of the movable contactors 103 move substantially horizontally (in FIG. 1) so as to be separated from the stationary contacts 101*a*. As a result, the movable contactors 103 are electrically disconnected from the stationary contactors 101 respectively.

Embodiment 2

Figure 8:
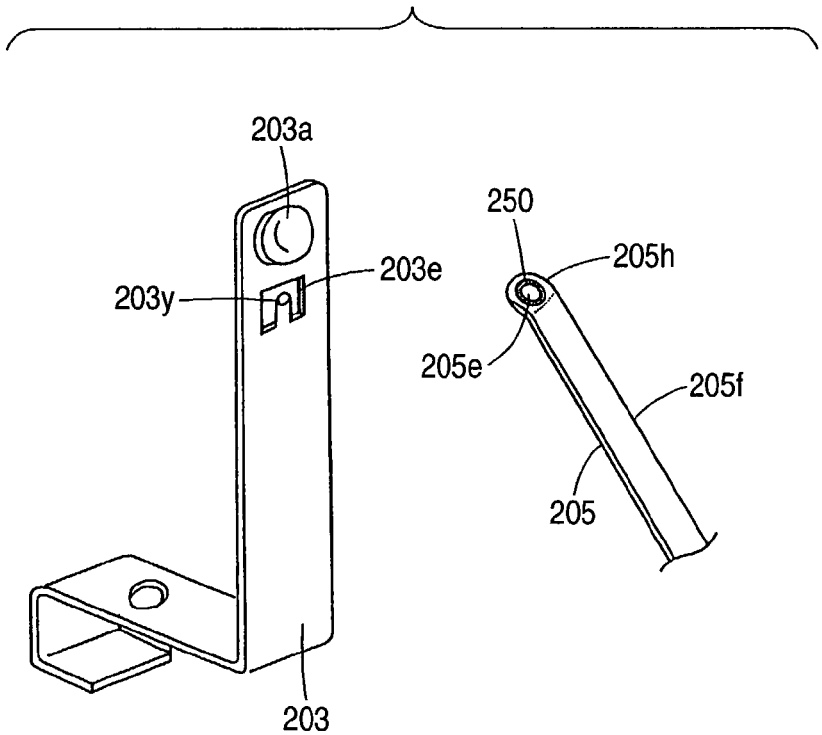
FIG. 8 is an exploded perspective view of an operational arm and a movable contactor in another embodiment of the invention.

Another embodiment of the invention will be described with reference to FIG. 8. FIG. 8 is an exploded perspective view of a movable contactor and an operational arm in another embodiment of the invention.

In FIG. 8, the movable contactor 203 is made of the same material as that of the movable contactor 103 and has substantially the same shape as that of the movable contactor 103. The movable contactor 203 is different from the movable contactor 103 in that a reverse-U-shaped hole 203*e* is formed below a contact 203*a* to thereby form a protrusive piece 203*y*.

On the other hand, the operational arm 205 is made of the same material as that of the operational arm 105 and has substantially the same shape as that of the operational arm 105. The operational arm 205 is different from the operational arm 105 as follows. A hook 205*h* bent outward at a predetermined angle is provided at a forward end portion of each of finger pieces 205*f* in order to strengthen the engagement between the finger piece 205*f* and the protrusive piece 203*y* of the stationary contactor 203, a hole 205*e* is formed in the hook 205*h*, and the operational arm 205 has an eyelet rivet 250 made of metal caulked in the hole 205*e*.

Holes of the eyelet rivets 250 fixed to the operational arm 205 are engaged with the protrusive pieces 203*y* of the movable contactors 203 to thereby form a displacement enlarging member.

Accordingly, the movable contactors 203 can be easily coupled with the operational arm 205 through the protrusive pieces 203*y* of the movable contactors 205 each made of an electrical conductor and the holes of the eyelet rivets 250 fixed to the operational arm 205 each made of an electrical insulator, so that a displacement enlarging member can be formed. Moreover, because the holes 205*e* of the operational arm 205 are protected by the eyelet rivets 205 respectively, the holes 205*e* are prevented from being deformed.

Embodiment 3

Figure 9:
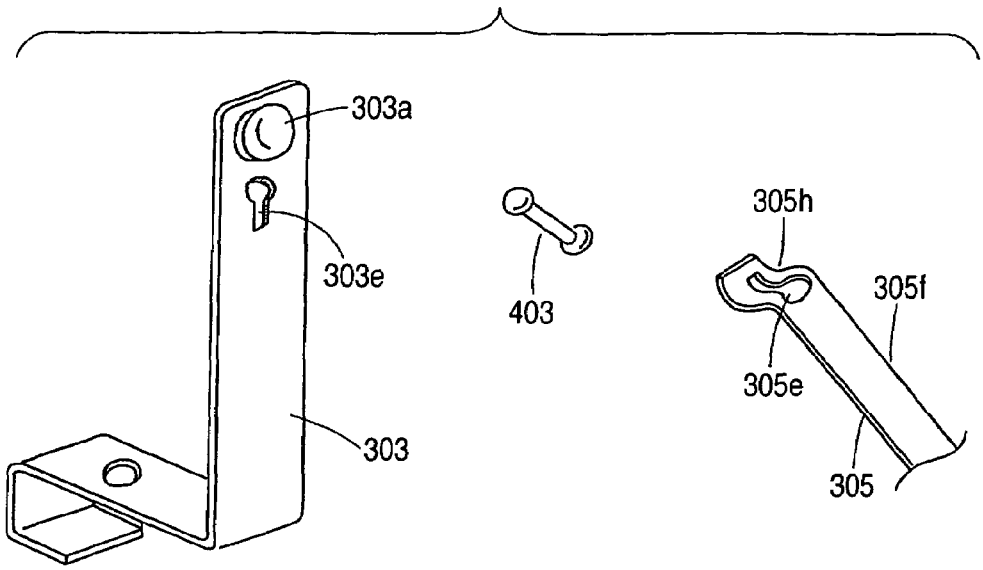
FIG. 9 is an exploded perspective view of an operational arm and a movable contactor in a further embodiment of the invention.
Figure 10:
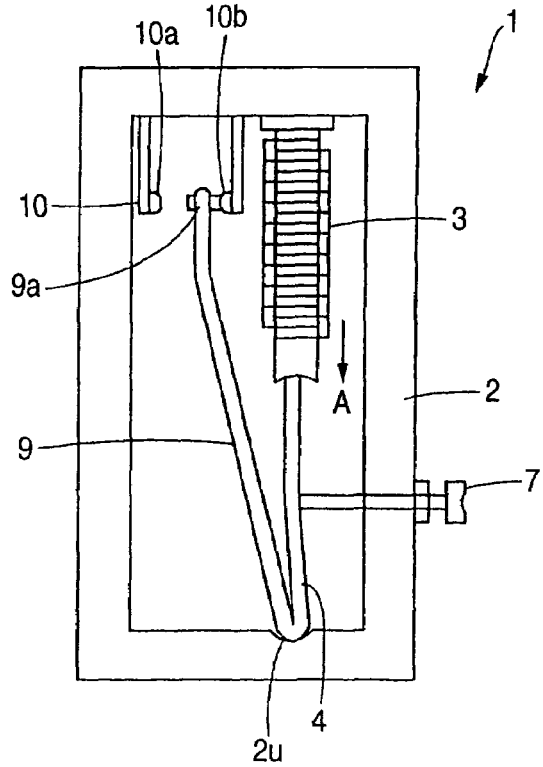
FIG. 10 PRIOR ART
FIG. 10 is a front sectional view showing a conventional electrical switch.
Figure 11:
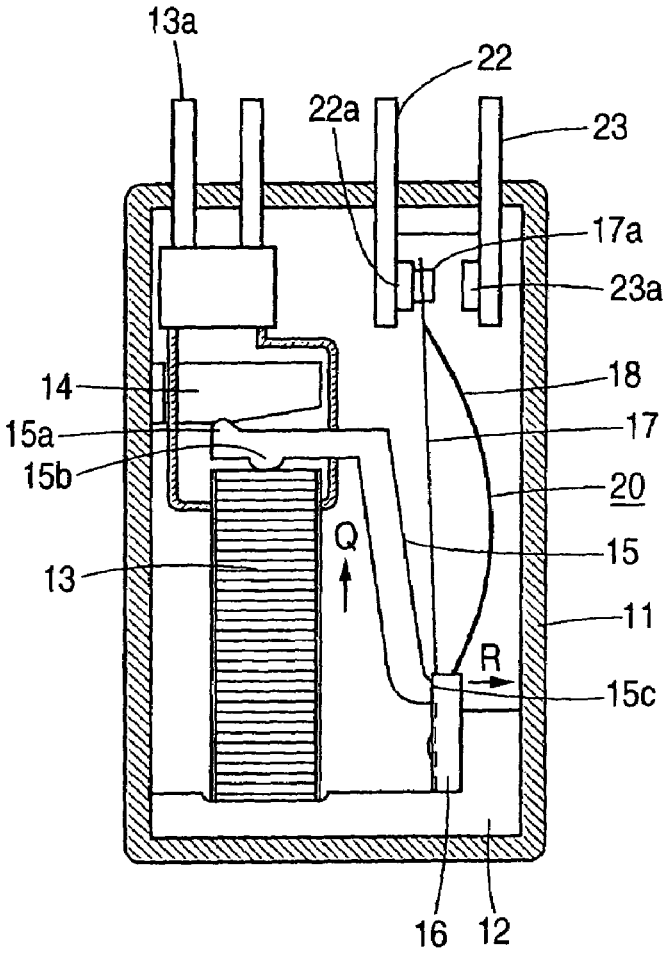
FIG. 11 PRIOR ART
FIG. 11 is a front sectional view showing another conventional electrical switch.

A further embodiment of the invention will be described with reference to FIG. 9. FIG. 9 is an exploded perspective view of a movable contactor and a stationary contactor in a further embodiment of the invention.

In FIG. 9, the movable contactor 303 is made of the same material as that of the movable contactor 103 and has substantially the same shape as that of the movable contactor 103. The movable contactor 303 is different from the movable contactor 103 in that a first hole 303*e* shaped like a keyhole is formed below a contact 303*a*.

On the other hand, the operational arm 305 has substantially the same shape as that of the operational arm 105. The operational arm 305 is different from the operational arm 105 as follows. That is, the operational arm 305 is made of a metal which is an electrical conductor, a hook 305*h* curved outward is provided at a forward end portion of each of finger pieces 305*f*, and a second hole 305*e* shaped like a keyhole is formed in the hook 305*h*.

A coupling member 403 is made of an electrically insulating material and shaped like a dumbbell for performing coupling by use of the first hole 303*e* of the movable contactor 303 and the second hole 305*e* of the operational arm 305. The movable contactor 303 and the operational arm 305 are integrated with each other by the coupling member 403 through the first hole 303*e* and the second hole 305*e* to thereby form a displacement enlarging member.

Accordingly, the operational arm 305 and the movable contactor 303 can be easily coupled with each other by use of the coupling member 403 made of an electrical insulator through the first hole 303*e* of the movable contactor 303 and the second hole 305*e* of the operational arm 305 to thereby form a displacement enlarging member. At the same time, the operational arm 305 and the movable contactor 303 can be kept electrically insulated from each other.

Because the invention is configured as described above, the following effects can be fulfilled.

According to the invention, the displacement of forward end portions of movable contactors can be enlarged to a predetermined quantity on the basis of slight translational displacement of a movable portion without having any complex displacement enlarging mechanism. Accordingly, there is an effect that movable contacts of the movable contactors and stationary contacts of stationary contactors can be operated to be electrically connected/disconnected to/from each other smoothly.

Next, according to the invention, there is an effect that it is easy to process a movable contactor and an operating member.

Next, according to the invention, a plurality of stationary contactors are fixed to the pillar so that a plurality of movable contacts are electrically connected/disconnected to/from stationary contacts correspondingly and respectively. Hence, there is an effect that a current switching function can be mounted compactly on the pillar of the mount portion.

Next, according to the invention, there is an effect that opposite ends of the stationary contactors can be easily fixed into engagement grooves provided in the pillar of the mount portion.

Next, according to the invention, there is an effect that dispersion of arc generated by connection/disconnection between the stationary contacts and the movable contacts can be blocked by the concave portion.

Next, according to the invention, there is an effect that the movable contactors and the operating member can be easily coupled with each other through the holes of the movable contactors and the hooks of the operating member even in the case where the movable contactors each made of an electrical conductor and the operating member, for example, made of an electrical insulator are provided as separate members.

Next, according to the invention, there is an effect that the movable contactors and the operating member can be easily coupled with each other through the protrusive pieces of the movable contactors and the holes of the eyelet rivets fixed to the operating member, and the holes of the operating member can be hardly deformed even in the case where the movable contactors each made of an electrical conductor and the operating member, for example, made of an electrical insulator are provided as separate members.

Next, according to the invention, there is an effect that the operating member and the movable contactors can be kept electrically insulated from each other while these two kinds of members are easily coupled with each other by coupling members each made of an electrical insulator, through the first holes of the movable contactors and the second holes of the operating member.

INDUSTRIAL APPLICABILITY

As described above, the electrical switch according to the invention is adapted for opening/closing an electric current through contacts.

What is claimed is:

1. An electric switch characterized by comprising:

a housing;

a plurality of stationary contactors each including a stationary contact;

drive means received in the housing and including a movable portion which moves translationally from a first position to a second position when a voltage is applied thereto and which returns back from the second position to the first position when the voltage is removed;

a mount portion provided in the center portion of the housing so as to be protrusive and having a pillar for fixing contact portions having the stationary contacts of the stationary contactors;

a plurality of movable contactors electrically insulated from one another and each including a beam material having one end portion coupled with and fixed to the housing, and the other end portion provided with a movable contact electrically connected/disconnected to/from corresponding one of the stationary contacts; and an operating member having one end coupled with a movable portion of the drive means, and the other end connected to the other end portions of the movable contactors, wherein the operating member and the movable contactors form a substantially V shape.

2. An electrical switch according to claim 1, characterized in that engagement grooves are provided in the pillar of the mount portion so that the stationary contactors are engaged with and fixed into the engagement grooves respectively.

3. An electrical switch according to claim 1 or 2, characterized in that:

a concave portion having an opening is provided in the pillar of the mount portion; and the contact portions having the stationary contacts of the stationary contactors are inserted in the opening of the concave portion.

4. An electrical switch according to claim 1 or 2, characterized in that:

a substantially T-shaped hole is formed in a neighbor of each of the movable contacts of the movable contactors; and substantially T-shaped hooks are formed in the other end portion of the operating member.

5. An electrical switch according to claim 1 or 2, characterized in that:

a hole having a protrusive piece is formed in a neighbor of each of the movable contacts of the movable contactors;

holes are formed in the operating member so that the protrusive pieces are engaged with the holes respectively; and eyelet rivets each made of a metal are caulked in the holes respectively.

6. An electrical switch according to claim 1 or 2, characterized in that:

a first hole is formed in a neighbor of each of the movable contacts of the movable contactors;

the operating member is made of an electrical conductor and second holes are formed at a forward end portion of the operating member so as to be curved; and coupling members each of which is made of an electrically insulating material and shaped like a dumbbell are provided for coupling the first holes of the movable contactors with the second holes.

7. An electric switch characterized by comprising:

a housing;

a plurality of stationary contactors each including a stationary contact;

an actuator received in the housing and including a movable portion which moves translationally from a first position to a second position when a voltage is applied thereto and which returns back from the second position to the first position when the voltage is removed;

a mount portion provided in the center portion of the housing so as to be protrusive and for fixing contact portions having the stationary contacts of the stationary contactors;

a plurality of movable contactors electrically insulated from one another and each including a beam material having one end portion coupled with and fixed to the housing, and the other end portion provided with a movable contact electrically connected/disconnected to/from corresponding one of the stationary contacts; and an operating member having one end coupled with a movable portion of the drive means, and the other end connected to the other end portions of the movable contactors, wherein the operating member and the movable contactors together form a substantially V shape.

* * * * *